US005573629A

United States Patent [19]

Rock et al.

[11] Patent Number: 5,573,629

[45] Date of Patent: Nov. 12, 1996

[54] TAPE APPLICATION APPARATUS

[75] Inventors: Reinhold Rock, Westlake; Josef Schuessler, Brecksville, both of Ohio

[73] Assignee: Herd Manufacturing, Inc., Cleveland, Ohio

[21] Appl. No.: 285,649

[22] Filed: Aug. 3, 1994

[51] Int. Cl.[6] ..... B32B 31/18

[52] U.S. Cl. ..... 156/522; 156/269; 156/270; 156/267; 83/42; 83/255; 83/468.6; 83/945; 242/423.1; 242/595.1

[58] Field of Search ..... 242/423.1, 419, 242/421, 595.1, 594.1, 594.2; 83/42, 48, 255, 468.6, 945; 156/269, 522, 552, 270, 267, 577, 554

[56] References Cited

U.S. PATENT DOCUMENTS

| | | | |
|---|---|---|---|
| 2,169,226 | 8/1939 | Cormack | 156/270 |
| 2,456,059 | 12/1948 | Grupe | 156/269 |
| 2,523,951 | 9/1950 | Graumlich | 242/423.1 |
| 2,643,016 | 6/1953 | Steckling . | |
| 2,649,221 | 8/1953 | Wagner et al. . | |
| 2,653,727 | 9/1953 | Wagner et al. . | |
| 2,779,385 | 1/1957 | Carlzen et al. | 156/552 X |
| 2,862,846 | 12/1958 | Blackford et al. | 156/269 X |
| 3,222,241 | 12/1965 | Curtis | 156/577 X |
| 3,310,452 | 3/1967 | Hartley et al. | 156/577 X |
| 3,536,569 | 10/1970 | Gosnell | 156/577 |
| 3,753,837 | 8/1973 | Lense | 156/522 X |
| 3,892,618 | 7/1975 | Griebat | 156/577 X |
| 3,900,362 | 8/1975 | Schaffer | 156/577 |
| 4,194,941 | 3/1980 | Briggs et al. | 156/361 |
| 4,227,955 | 10/1980 | Woods et al. | 156/289 X |
| 4,680,079 | 7/1987 | Tanaka | 156/522 X |
| 5,294,282 | 3/1994 | Rock et al. . | |

FOREIGN PATENT DOCUMENTS

| | | | |
|---|---|---|---|
| 0084661 | 6/1980 | Japan | 156/552 |
| 0074041 | 12/1986 | Japan | 156/269 |
| 1114425 | 5/1989 | Japan | 156/270 |
| 0079730 | 1/1982 | United Kingdom | 242/423.1 |

*Primary Examiner*—David A. Simmons
*Assistant Examiner*—Steven J. Helmer
*Attorney, Agent, or Firm*—Tarolli, Sundheim, Covell, Tummino & Szabo

[57] ABSTRACT

An apparatus 10 applies segments of adhesive tape 14 to workpieces 20. A supply station 24 provides the continuous strip of tape 14. An application station 28 forces the continuous strip of adhesive tape 14 against successive workpieces 20 as each workpiece 20 and the continuous strip of adhesive tape 14 are moved relative to the application station 28. Two stop mechanisms 120 and 166 are provided. A mover 102 moves first and second workpieces **20*a* and 20*b* which are interconnected by a portion of the continuous strip of tape 14 until and end of the second workpiece 20*b* engages the first stop mechanism 120. A first sever mechanism 124 severs the continuous strip of tape 14. A second mover 214 moves the first workpiece 20*a* until the end of the first workpiece 20*a* engages the second stop mechanism 166. A second sever mechanism 170 severs a segment of tape associated with the first workpiece 20*a*** from a trailing segment of tape.

26 Claims, 9 Drawing Sheets

TAPE APPLICATION APPARATUS

BACKGROUND OF THE INVENTION

The present invention relates to an apparatus for applying segments of adhesive tape to workpieces. In particular, the present invention relates to an apparatus for applying a continuous strip of the adhesive tape to the workpieces and for cutting the continuous strip of adhesive tape which is attached to the workpieces.

A typical workpiece is a body side molding strip for a vehicle. The molding strip is elongate and is made of resilient material, such as rubber. The molding has a flat, back side on which a strip of double-side adhesive tape is attached during a preparation step. The molding is mounted on the vehicle by removing a protective backing to expose a surface of the tape and pressing the tape and the attached molding against the vehicle.

The molding has an outer profile which is aesthetically or functionally designed. For example, the profile may be rounded and/or notched. Also, the molding has ends which are straight or curved. In order to ensure proper adhesion between the adhesive tape and the molding during the preparation step, the adhesive tape must be pressed onto the molding with a sufficient force over the entire area of the tape. Also, in order to ensure a finished appearance on the vehicle, the adhesive tape must not extend beyond the molding. The molding strip, with the attached adhesive tape, should be prepared in a quick and efficient manner.

SUMMARY OF THE INVENTION

The present invention provides an apparatus for applying segments of adhesive tape to workpieces. The apparatus includes supply means for providing a continuous strip of adhesive tape. The continuous strip of tape is forced against successive workpiece by a force means as each workpiece and the continuous strip of tape are moved relative to the force means.

The apparatus includes a first stop means. A first mover means moves first and second workpieces until an end of the second workpiece engages the first stop means. The first and second workpieces are interconnected by a portion of the continuous strip. A first sever means severs the continuous strip of tape adjacent to the end of the second workpiece to separate the first workpiece, a segment of tape associated with the first workpiece and the portion of tape from the second workpiece and a remainder of the continuous strip of tape.

The apparatus includes second stop means. A second mover means moves the first workpiece until an end of the first workpiece engages the second stop means. A second sever means severs the segment of tape associated with the first workpiece from the portion of tape adjacent to an end of the first workpiece to separate the first workpiece and the segment of tape associated with the first workpiece from the portion of tape.

In a preferred embodiment, the supply means provides the continuous strip of tape from a roll at a constant resistance. The supply means includes support means for supporting the roll of tape. A guide means guides the movement of the roll of tape along the support means. A resistance means resists movement of the tape. A retainer means engages the roll of tape and retains each successive layer of the tape on the roll until the respective layer of tape is pulled across the retain means. A bias means biases the roll of tape against the retainer means.

Also in a preferred embodiment, the force means includes a roller. A deformable outer surface means on the roller deforms as each workpiece engages the roller to congruently conform to the profile of each workpiece and distribute a pressure force across the profile of the workpiece.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENTS OF THE PRESENT INVENTION

Figure 1:
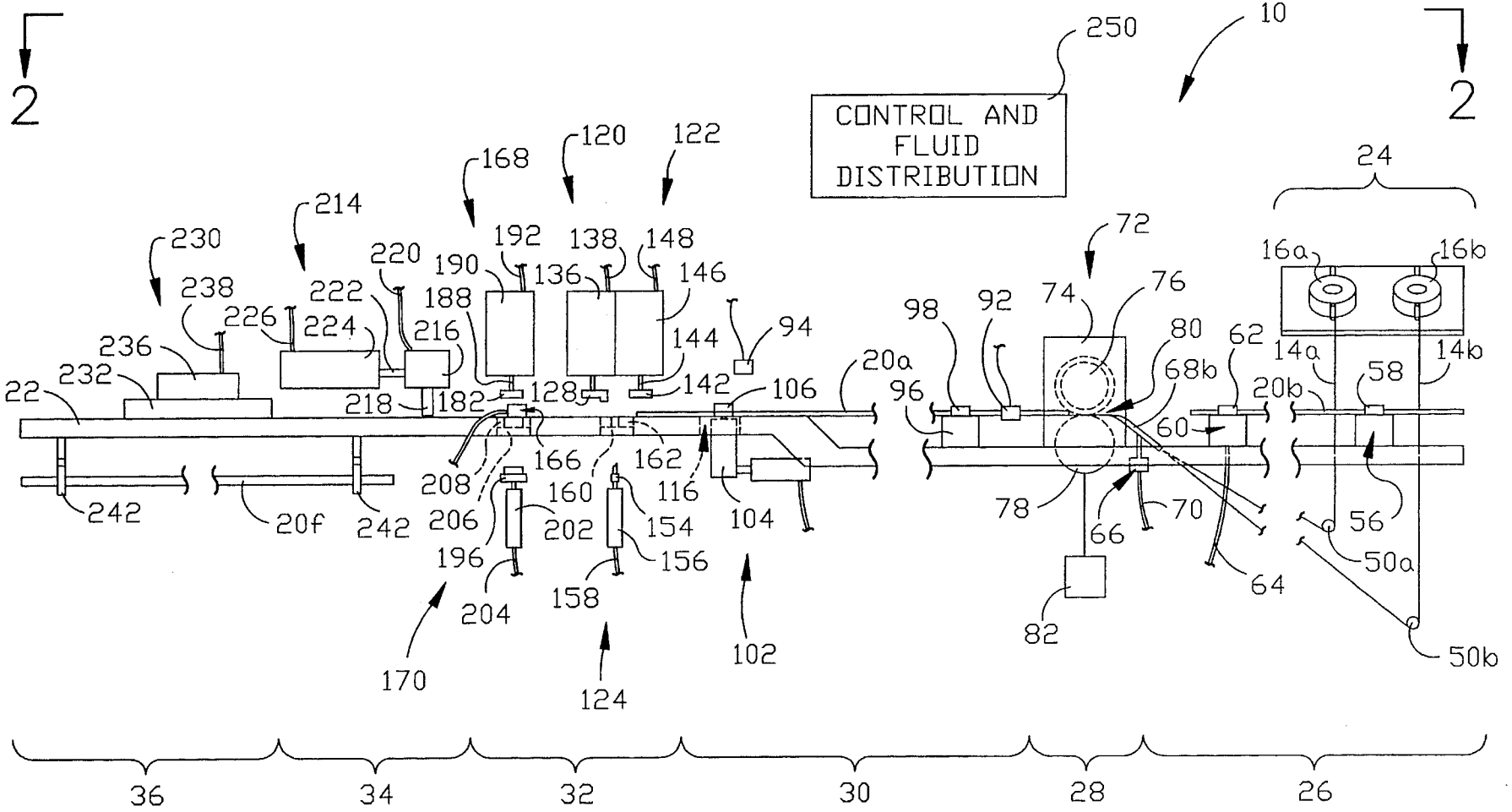
FIG. 1 is a schematic elevational view of an apparatus constructed in accordance with the present invention.
Figure 2:
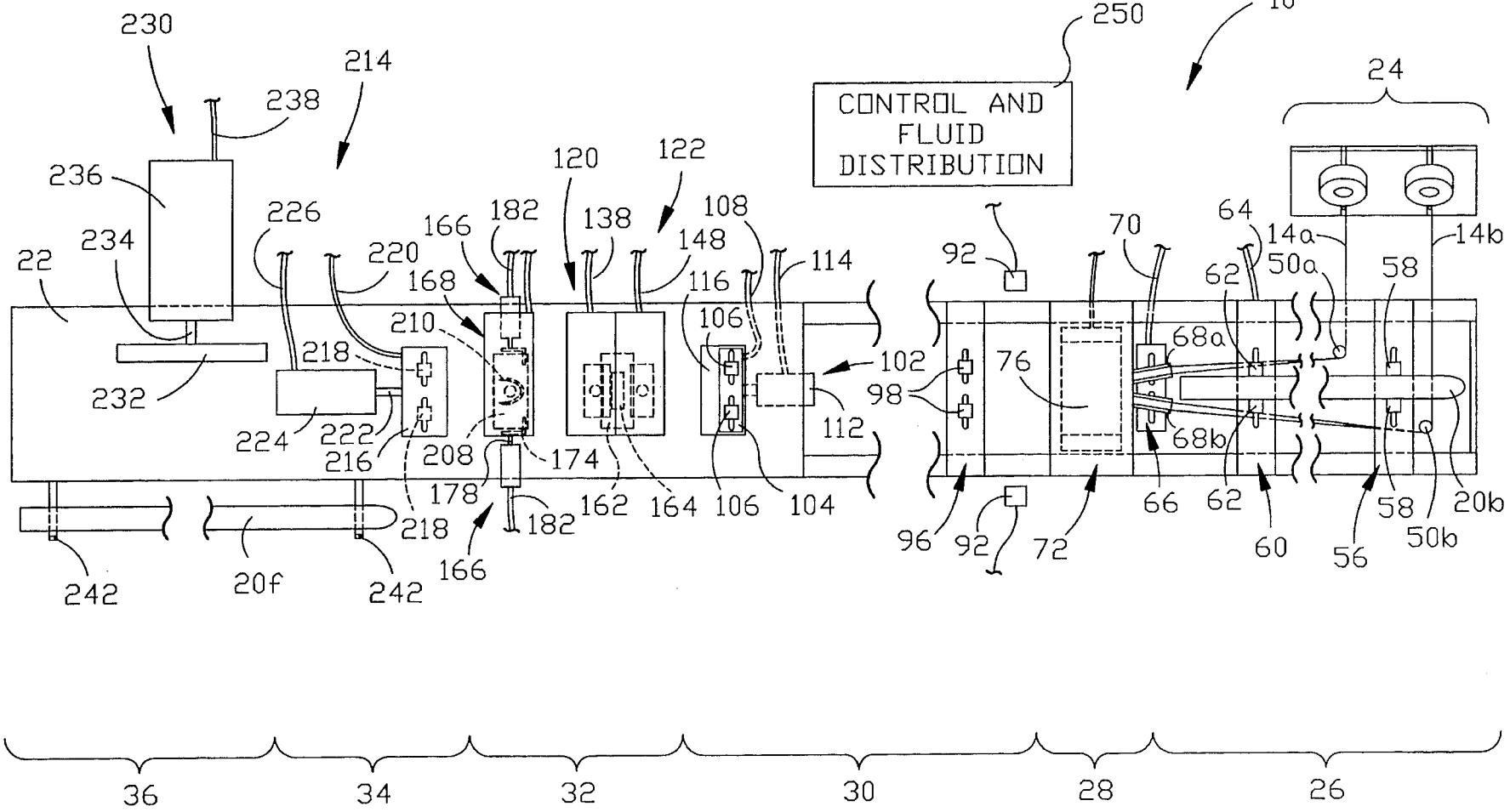
FIG. 2 is a schematic plan view, taken generally along the line 2—2 of FIG. 1, with a workpiece removed for clarity.

An apparatus 10 according to the present invention is shown in FIGS. 1 and 2. The apparatus 10 applies a continuous strip of adhesive tape 14 from a storage roll 16 to each of several workpieces 20. The apparatus also severs the tape 14 to fit each workpiece 20. In a preferred embodiment, two continuous strips of tape **14*a* and 14*b* are simultaneously provided by respective rolls 16*a* and 16*b* for application to each respective workpiece 20. Hereinafter, the two continuous strips of tape 14*a* and 14*b* will be referred to by their individual designations (i.e., 14*a* and 14*b*) when an individual, tape-specific detail is discussed and will be referred to collectively as the continuous strip of tape 14** when an identical tape-collective detail is discussed.

The use of two continuous strips of tape 14*a* and 14*b* allows the strips of tape to be spaced apart a variable distance and to be adhered to each workpiece 20 adjacent opposite elongate sides of each workpiece 20 regardless of the width of each respective workpiece 20. Each continuous strip of tape 14*a* and 14*b* is a double-sided adhesive tape with a removable backing on one side to allow handling. Each continuous strip of tape 14*a* and 14*b* extends from a respective roll 16*a* and 16*b* with the backing facing outward.

The apparatus 10 (FIG. 1) is designed to process numerous workpieces 20 sequentially. FIG. 1 illustrates leading and trailing workpieces 20*a* and 20*b* which are located at different, sequential locations along the apparatus 10. FIG. 1 also illustrated a finished workpiece 20*f*. The convention terminology of leading and following is used to denote the sequential relationship of two adjacent workpieces 20, with the understanding that each workpiece 20 is trailing relative to the proceeding workpiece and leading relative to the subsequent workpiece. Hereinafter, the workpieces 20 will be referred to by their individual designations (i.e., 20*a*, 20*b* and 20*f*) when an individual, workpiece distinctive detail is discussed and will be referred to generically, as the workpiece 20. Each workpiece 20 is elongate with respective ends which are either straight or curved. Each workpiece 20 has a flat, back side onto which the continuous strip of tape 14 is applied and a contoured outer profile. All of the workpieces 20 of a batch-run are typically identical.

The apparatus 10 includes an elongate support track 22, a tape supply station 24, a workpiece feed station 26, and an application station 28. The apparatus 10 also includes a transfer station 30, a cutting station 32, a position/removal station 34 and an off-feed station 36.

Figure 3:
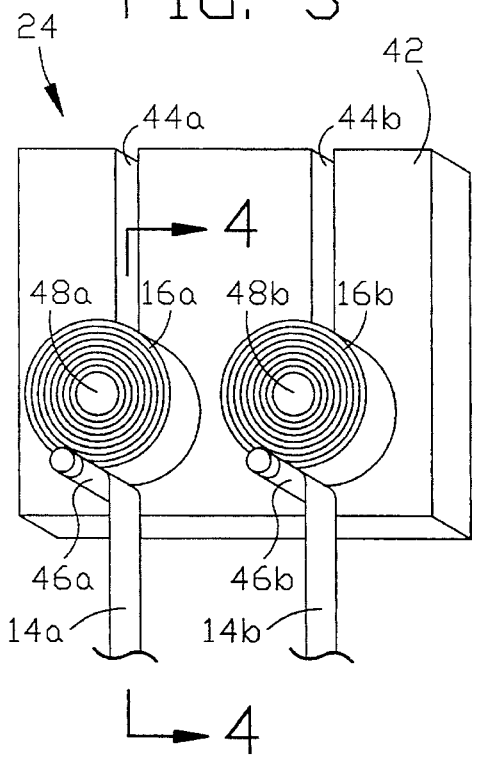
FIG. 3 is an enlarged perspective view of a tape supply station of the apparatus of FIG. 1.
Figure 4:
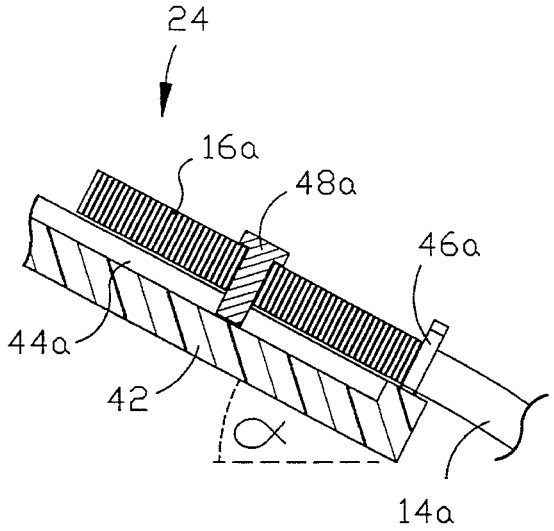
FIG. 4 is a view taken along line 4—4 of FIG. 3.

The tape supply station 24 (FIG. 3) supplies the continuous strip of tape 14. The tape supply station 24 includes a planar member 42 which is inclined at an angle α (FIG. 4) to the horizontal. The planar member 42 has elongate grooves 44*a*, 44*b* (FIG. 3) which are associated with respective rolls 16*a* and 16*b*. Each groove 44*a* and 44*b* extends partially along the planar member 42 from an upper end of the planar member 42 toward a lower portion of the planar member 42. Roller pins 46*a* and 46*b* are mounted on the planar member 42 adjacent to respective ends of the grooves 44*a* and 44*b*. The roller pins 46*a* and 46*b* extend perpendicularly to the planar member 42. Weights 48*a* and 48*b* extend through the center of the rolls 16*a* and 16*b*, respectively.

Each continuous strip of tape 14*a* and 14*b* is supplied from its respective roll 16*a* and 16*b* at the tape supply station 24 in a similar manner. Thus, only roll 16*a* is described, with the understanding that roll 16*b* functions in a similar manner. The roll 16*a* is placed flat against the planar member 42. The weight 48*a* is positioned through the center of the roll 16*a* such that the weight 48*a* extends into the groove 44*a* and prevents movement of the weight 48*a* and the roll 16*a* along the face of the planar member 42 in directions which are transverse to the groove 44*a*. Thus, the weight 48*a* and the roll 16*a* only slide as a unit in a direction of descent along the face of the planar member 42 along the groove 44*a*.

Due to the inclination of the planar member 42 and the mass of the weight 48*a*, the weight 48*a* and the roll 16*a* are biased toward the lower end of the groove 44*a*. The roll 16*a* abuts against the roller pin 46*a*, backing side out. As the continuous strip of tape 14*a* is pulled from the roll 16*a*, the backing slides across the roller pin 46*a*. The roll 16*a* and the weight 48*a* are gravity fed such that the roll 16*a* remains engaged with the roller pin 46*a*.

Removal of the continuous strip of tape 14*a* from the roll 46*a* is accomplished when the pulling force is sufficient to overcome the adhesion force to the backing of a subsequent layer. Thus, the continuous strip of tape 14*a* is provided at a substantially constant resistance. Moreover, as the continuous strip of tape 14*a* is pulled, the roll 16*a* rotates. However, rotation of the roll 16*a* is resisted by friction between the planar member 42 and the roll 16*a*. Thus, the roll 16*a* is prevented from over-rotating such that successive layers of the continuous strip of tape 14*a* are retained on the roll 16*a* until the respective layer of tape is pulled across the roller pin 46*a*.

The tape supply station 24 (FIG. 1) is located adjacent to a first end portion of the track 22 and offset from the track 22. Each continuous strip of tape 14*a* and 14*b* is first directed perpendicular to the extent of the support track 22 to a location beneath the support track 22. Beneath the support track 22 are direction rollers 50*a* and 50*b* which engage the backing of the continuous strips of tape 14*a* and 14*b*, respectively. The direction rollers 50*a* and 50*b* redirect the continuous strips of tape 14*a*, 14*b* in a direction generally along the extent of the support track 22 and generally upward toward the application station 28.

The workpiece feed station 26 is located adjacent to the tape supply station 24 at the first end portion of the support track 22. An operator of the apparatus 10 manually feeds successive workpieces 20 into the apparatus 10 at the workpiece feed station 26. The workpiece feed station 26 includes a workpiece guide 56 fixed on the support track 22. The workpiece guide 56 has movable side bumpers 58 (FIG. 2) which are manually adjustable. The width of the spacing between the movable side bumpers 58, transverse to the extent of the support track 22, is adjustable such that each workpiece 20 is centered on the workpiece guide 56 relative to the support track 22.

The workpiece feed station 26 includes a pneumatic workpiece guide 60 fixed on the support track 22. The workpiece guide 60 includes pneumatically moved side bumpers 62. The side bumpers 62 are biased inward, transverse to the extent of the support track 22 by pneumatic pressure supplied by a fluid line 64 to center each workpiece 20. The operator places each successive workpiece 20 into the workpiece guides 56 and 60 and pushes the workpiece 20 toward the application station 28, which is located downstream (toward the left in FIGS. 1 and 2) of the workpiece feed station 26.

Figure 5:
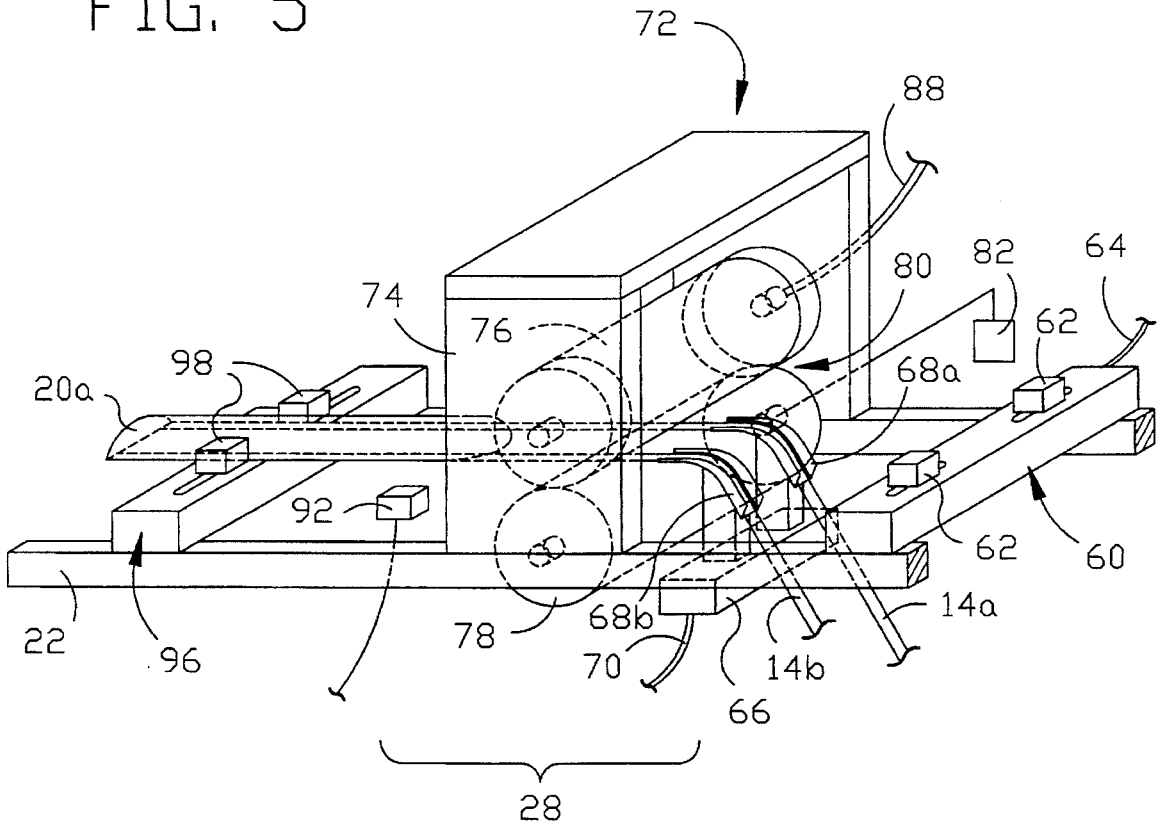
FIG. 5 is an enlarged perspective view of an application station of the apparatus of FIG. 1 showing parts in a first operational position.

The application station 28 (FIG. 5) joins each successive workpiece 20 to the continuous strips of tape 14*a* and 14*b*. The application station 28 includes a pneumatic tape guide 66 (shown schematically). The tape guide 66 includes two tape ramps 68*a* and 68*b* for the continuous strips of tape 14*a*, 14*b*, respectively. The ramps 68*a* and 68*b* (FIG. 2) are movable transverse to the extent of the support rack 22 to vary the spacing distance between the continuous strips of tape 14*a* and 14*b*. The ramps 68*a* and 68*b* are biased inward by a pneumatic pressure provided by a fluid line 70.

As each successive workpiece 20 (FIG. 6) moves over the tape guide 66, the ramps 68*a* and 68*b* are moved outwardly against the pneumatic pressure to follow an outer side contour of the workpiece 20. Thus, the ramps 68*a* and 68*b* align the continuous strips of tape 14*a* and 14*b* with the outer edges of the workpiece 20 as the workpiece 20 and the continuous strips of tape 14*a* and 14*b* are moved toward and through a press 72 of the application station 28.

Figure 14:
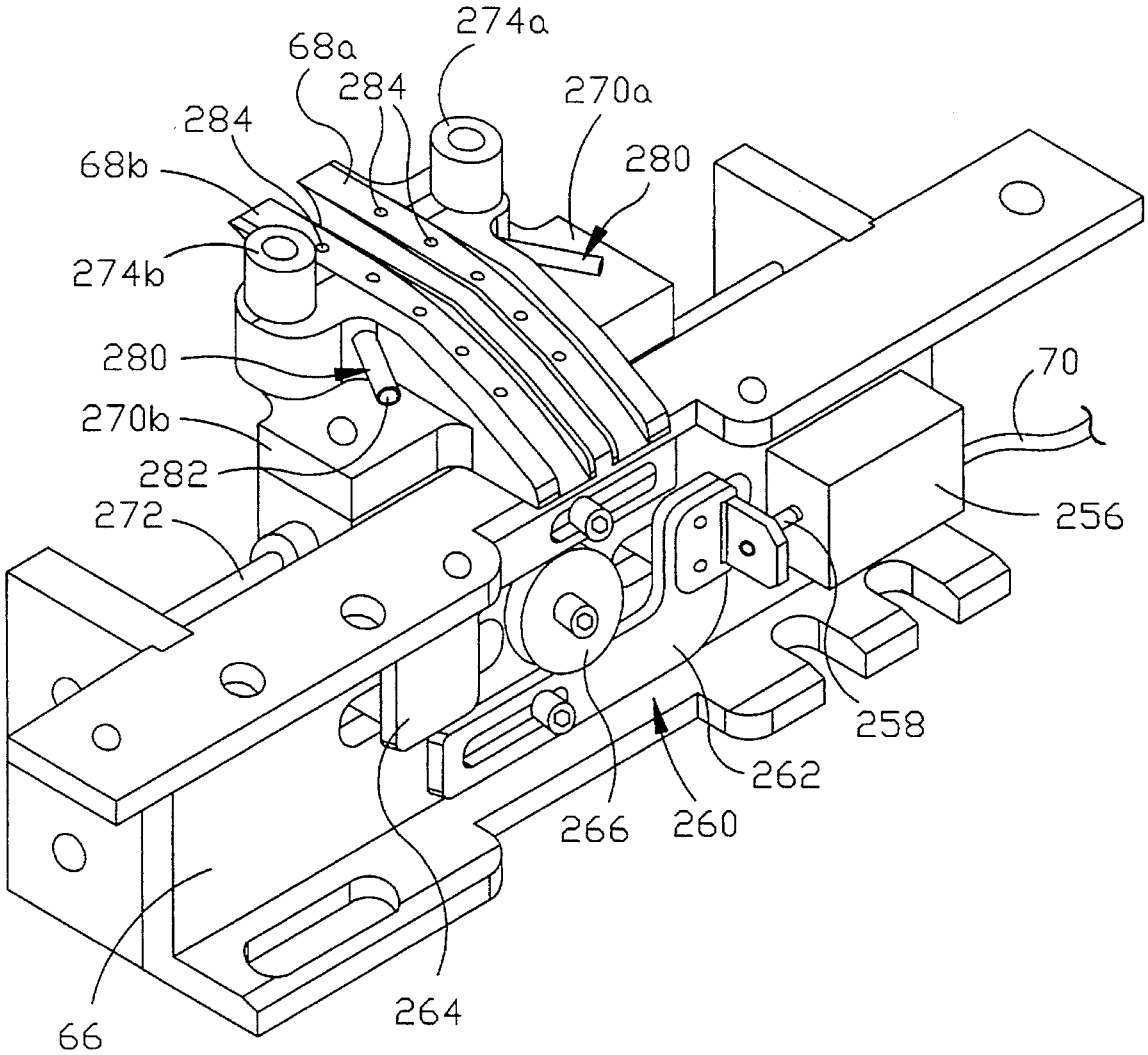
FIG. 14 is a perspective view showing details of structure of a portion of the apparatus shown in FIG. 1.

A preferred embodiment of the tape guide 66 is shown in FIG. 14. The tape guide 66 includes a cylinder 256, a piston 258 and a gear mechanism 260. The cylinder 256 is connected to the fluid line 70 and receives a pressurized fluid from the line 70. The piston 258 is attached to the gear mechanism 260 and is moved relative to the cylinder 256 under the influence of the fluid pressure within the cylinder 256.

The gear mechanism 260 includes two racks 262, 264 and an interconnecting pinion 266. The racks 262 and 264 engage the pinion 266 such that linear movement of one of the racks simultaneously moves the other. The piston 258 is attached to the rack 262 and moves the rack 262, the pinion 266 and the rack 264.

The tape guide 66 has two movable support blocks 270*a* and 270*b* upon which the ramps 68*a* and 68*b* are mounted, respectively. The support blocks 270*a* and 270*b* are mounted on a guide member 272. The support block 270*a* is attached to the rack 262 and the support block 270*b* is attached to the rack 264. The racks 262 and 264 are movable to simultaneously move the support blocks 270*a* and 270*b* toward and away from each other. Thus, the ramps 68*a* and 68*b* are movable toward and away from each other.

The support blocks 270*a* and 270*b* have rollers 274*a* and 274*b*, respectively, located laterally adjacent to the respective ramps 68*a* and 68*b*. Each workpiece 20 engages the rollers 274*a* and 274*b* and pushes the support blocks 270*a* and 270*b* outward against the bias provided by the fluid pressure within the cylinder 256. The ramps 68*a* and 68*b* are thus moved to follow the outer side edges of the workpiece 20 as the workpiece 20 tapers. The rollers 274*a* and 274*b* are laterally adjustable on the perspective support blocks 270*a* and 270*b* to vary a spacing between the respective roller and ramp. This allows the continuous strips of the tape 14*a* and 14*b* to be inset from the outer side edges of the workpiece 20.

Each of the ramps 68*a* and 68*b* include a venturi mechanism 280, which includes a fluid pressure inlet 282 and plurality of holes 284 in a face of the respective ramp. The holes 284 intersect with an internal passage (not shown) within the ramp 68*a*. The internal passage is connected to the fluid pressure inlet 282 to receive a flow of fluid such that a venturi effect vacuum is created in the holes 284. A fluid exhaust (not shown) of the internal passage is open to the atmosphere to vent the fluid.

The vacuum in the holes 284 provides a force which retains the continuous strips of tape 14*a* and 14*b* on the ramps 68*a* and 68*b*, respectively, during an initial set-up when the continuous strips of tape 14*a* and 14*b* are not adhered to a leading workpiece 20*a*. Once the initial step up is complete and the continuous strips of tape 14*a* and 14*b* are adhered to a leading workpiece 20*a*, the venturi mechanisms 280 may be disabled. Subsequently described structure of the apparatus 10 operates on the continuous strips of tape 14*a* and 14*b* simultaneously and thus the collective designation 14 is used herein.

Figure 6:
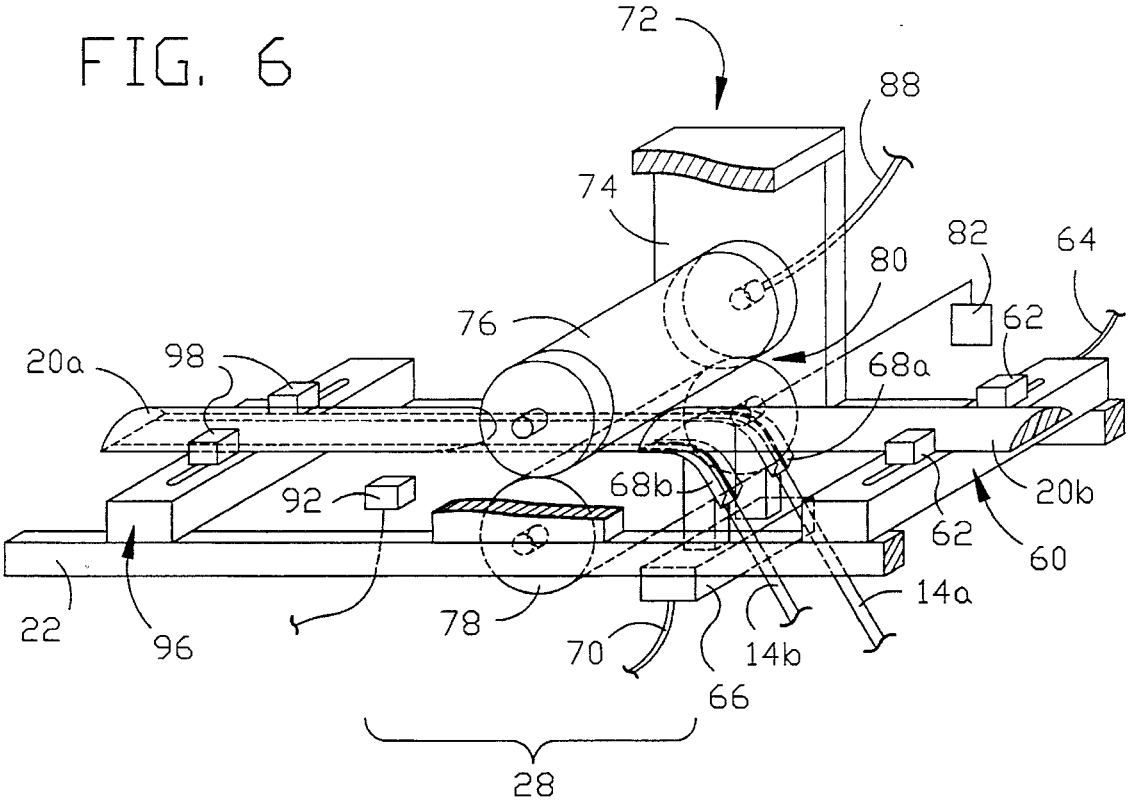
FIG. 6 is view similar to FIG. 5 showing the parts in another operational position.
Figure 7:
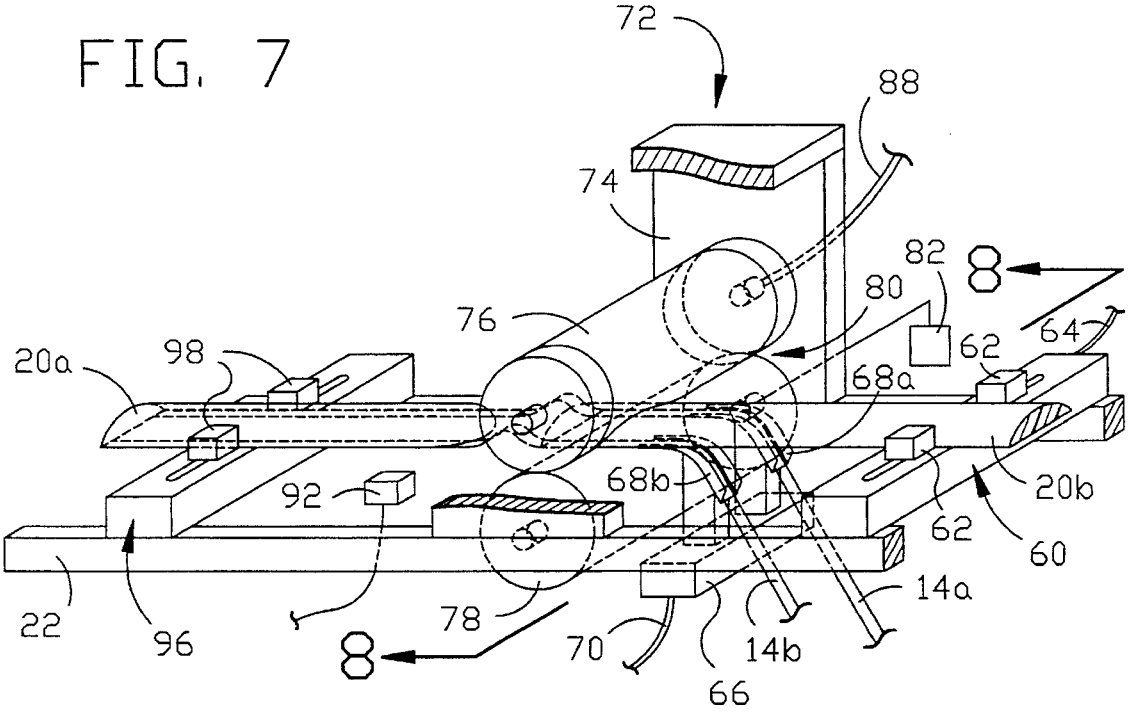
FIG. 7 is a view similar to FIG. 5 showing parts in yet another operational position.

The press 72 (FIG. 5) includes a support frame 74, a pneumatic roller 76 and a knurled roller 78. The support frame 74 is fixed on the support track 22 and holds the rollers 76 and 78 such that their rotational axes are perpendicular to the extent of the support track 22. The rollers 76 and 78 define a pressure applying nip 80, through which each successive workpiece 20 and the continuous strip of tape 14 are moved (FIG. 6). Each workpiece 20 and the continuous strip of tape 14 are pressed together at the nip 80 (FIG. 7).

Figure 8:
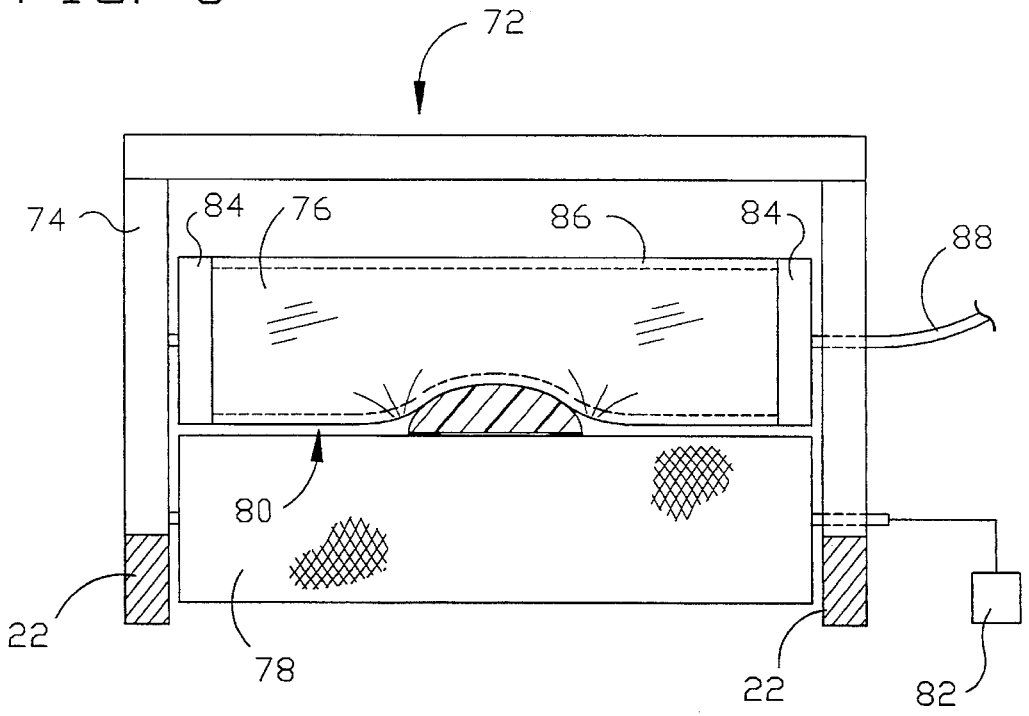
FIG. 8 is a view taken generally along line 8—8 of FIG. 7.

In the preferred embodiment, the roller 78 (FIG. 8) is a solid metal roller which has serrations for providing a gripping surface which rotates to move each successive workpiece 20 and the continuous strip of tape 14 through the nip 80. The roller 78 is connected to a drive mechanism 82 (schematically represented) for rotation of the roller 78. Thus, the drive mechanism 82, via the roller 78 provides a force for moving each successive workpiece 20 and the continuous strip of tape 14 through the nip 80 and along the support track 22 at the application station 28. In the preferred embodiment, the drive mechanism 82 is an electrical motor connected to the roller 78 via a drive chain and sprocket.

The roller 76 includes two end pieces 84 and a hollow cylindrical cover 86 which extends between the two end pieces 84. The hollow cover 86 is made of a resilient plastic or rubber which retains a pneumatic pressure within the roller 76. The pneumatic pressure provides a force which resists, and yet permits, deformation of the hollow cover 86. The hollow cover 86, and in particular an outer cylindrical surface of the cover 86, deforms congruently to the outer profile of each successive workpiece 20 as the workpiece 20 moves through the nip 80. The deformation distributes a pressing force across the workpiece 20 to ensure that the continuous strip of tape 14 is evenly adhered to each workpiece 20. The pneumatic pressure is supplied by a fluid line 88. In the preferred embodiment, the pneumatic pressure within the roller 76 is approximately 10 psi.

The operator of the apparatus 10 (FIG. 1) pushes each workpiece 20 from the workpiece feed station 26 into the application station 28 until a leading end portion of the workpiece 20 engages the continuous strip of tape 14 and enters the nip 80. Thereafter, the rollers 76 and 78 move the workpiece 20 from the workpiece feed station 26 and through the application station 28. Further, the workpiece 20, with the adhered portion of the continuous strip of tape 14 and a short following portion of the continuous strip of adhesive tape 14, are moved into the transfer station 30, which is located downstream of the application station 28.

The transfer station 30 provides a location at which each subsequent trailing workpiece 20*b* remains while the associated leading workpiece 20*a* is processed further and until the next subsequent workpiece 20, which is interconnected via the short following portion of the tape extending across a gap between the workpieces, enters the transfer station 30 from the application station 28. The transfer station 30 includes two sensors 92 and 94 for determining the presence of a workpiece 20 proximate to the respective sensor. Each of the sensors 92 and 94 can be any suitable sensor. In the preferred embodiment, each of the sensors 92 and 94 is a photoelectric "eye".

The sensor 92 is located adjacent to the application station 28 and detects the trailing end of each successive workpiece 20. Thus, the sensor 92 provides a signal which is indicative of a workpiece 20 moving along the support track 22 away from the application station 28. The sensor 94 is located above the support track 22 and detects any portion of the workpiece 20 in the transfer station 30. Thus, the sensor 94 provides a signal which is indicative of a workpiece 20 in the transfer station 30.

The transfer station 30 also includes a workpiece guide 96 which is fixed to the support track 22 and which retains each successive workpiece 20 aligned along the support track 22. The workpiece guide 96 includes movable side bumpers 98 which are manually adjustable. The width of the spacing between the movable side bumpers 98 is adjustable such that each workpiece 20 is centered relative to the support track 22.

Figure 9:
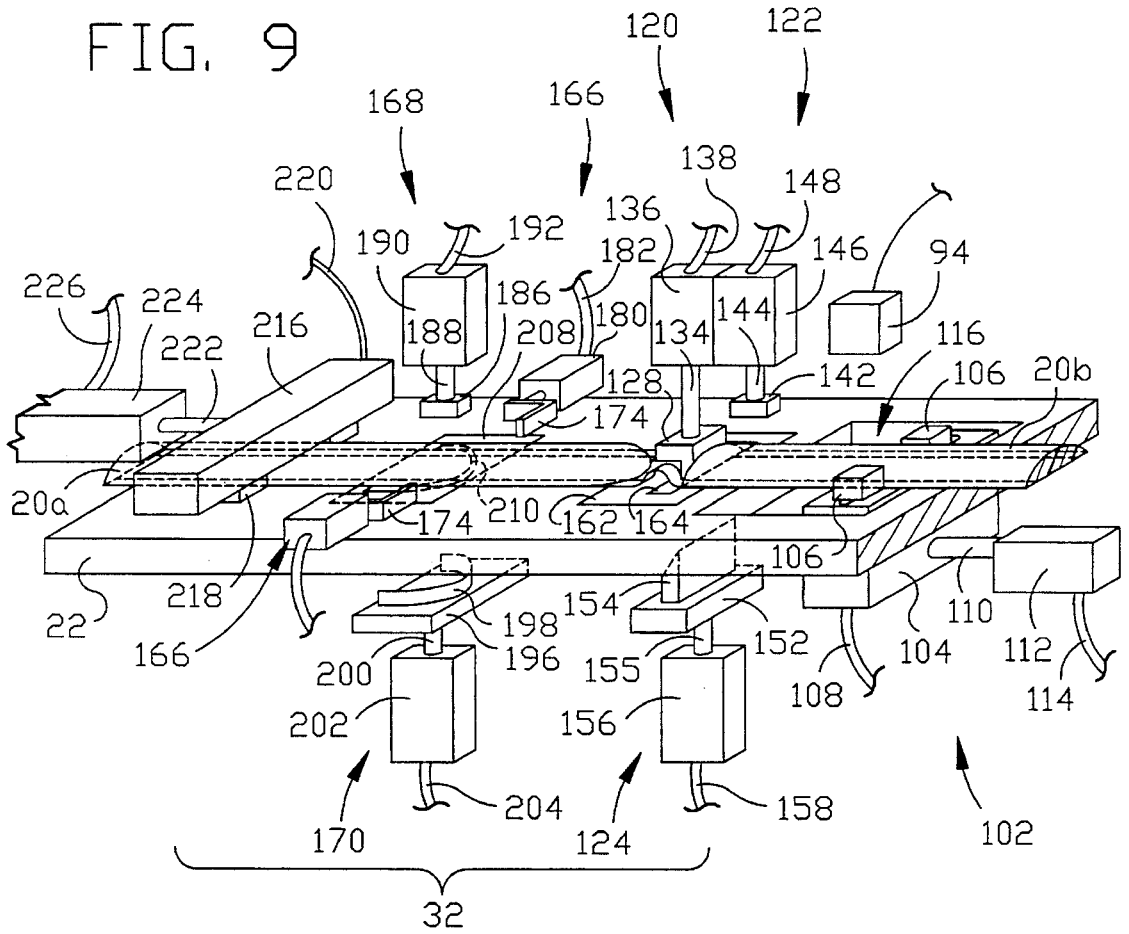
FIG. 9 is an enlarged perspective view of a cutting station of the apparatus of FIG. 1, showing parts in a first operational position.

A gripper/mover assembly 102 (FIGS. 1 and 2) is located at a downstream end of the transfer station 30. The gripper/ mover assembly 102 moves each subsequent trailing workpiece 20*b* (FIG. 9) a relatively short distance towards the cutting station 32 such that the greater part of the trailing workpiece 20*b* remains in the transfer station 30. The gripper/mover assembly 102 includes a grip head 104 which has grip fingers 106. The grip fingers 106 engage each subsequent trailing workpiece 20*b* in a pinching manner. The grip fingers 106 are moved inwardly to grip each trailing workpiece 20*b* under the influence of pneumatic pressure in the grip head 104 provided by a fluid line 108.

The grip head 104 is mounted on a piston 110 which is movable relative to a cylinder body 112 under the influence of a pneumatic pressure. The cylinder body 112 receives the pneumatic pressure from a fluid line 114. The gripper/mover assembly 102 is mounted on the support track 22 such that the cylinder body 112 is fixed below the support track 22 and the grip head 104 extends upward through an aperture 116 on the support track 22. The grip fingers 106 are positioned to engage each subsequent trailing workpiece 20*b* as the workpiece 20 rests upon the support track 22. When the grip fingers 106 engage each workpiece 20, the grip head 104 is moved toward the cutting station 32 to position a leading edge of the trailing workpiece 20*b* for a first sever operation on the continuous strip of tape 14 interconnecting the leading and trailing workpieces 20*a* and 20*b*.

The cutting station 32 is located downstream of the transfer station 30. The cutting station 32 (FIG. 1) has a first sever grouping which includes a stop mechanism 120, a hold-down mechanism 122 and a sever mechanism 124. The stop mechanism 120 (FIG. 9) is located above the support track 22 and includes an L-shaped stop head 128 mounted on a piston 134. The piston 134 is movable relative to a cylinder body 136 under the influence of pneumatic pressure in the cylinder body 136 provided by a fluid line 138. The cylinder body 136 is fixed relative to the support track 22 such that movement of the piston 134 moves the head 128 toward or away from the support track 22.

The head 128 is positionable at an up position (FIG. 1) to allow passage of the leading workpiece 20*a* and is positionable at a down position (FIG. 9) such that a leading edge of the trailing workpiece 20*b* will abut against an engagement face of the head 128 to stop movement of the trailing workpiece 20*b* in a position to allow the first sever operation to be performed. The L-shape of the head 128 allows the leg of the L-shape to extend into the gap between the leading and trailing workpieces 20*a* and 20*b* sufficiently close to the support track 22 such that the leading edge of a trailing workpiece 20*b* abuts the engagement face and yet the head 128 does not contact the leading workpiece 20*a*.

The hold-down mechanism 122 is located above the support track 122 and includes a head 142 for engaging each successive trailing workpiece 20*b*. The head 142 is mounted on a piston 144. The piston 144 is movable relative to a cylinder body 146 under the influence of a pneumatic pressure in the cylinder body 146 provided by a fluid line 148. Movement of the piston 144 relative to the cylinder body 146 moves the head 142 toward or away from the support track 22. When the head 142 is located in an up position, the leading workpiece 20*a* is free to pass. When the head 142 is moved to a down position and engages the trailing workpiece 20*b*, the trailing workpiece 20*b* is held in a position such that the first sever operation can take place.

The sever mechanism 124 is located below the support track 22 and includes a head 152 upon which a knife edge 154 is mounted. The knife edge 154 is configured in a shape to provide a desired cutting pattern. In the preferred embodiment, the knife edge 154 has a shape which is congruent to the shape of the leading edge of the workpieces 20. In the preferred embodiment, the knife edge 154 is sufficiently sharp to sever the continuous tape 14. In addition, or alternatively, the knife edge 154 is heated to a temperature sufficient to melt and sever the continuous strip of tape 14.

The head 152 is mounted on a piston 155 which is movable relative to a cylinder body 156. The cylinder body 156 is fixed relative to the support track 22 and receives a pneumatic pressure from a fluid line 158. The pneumatic pressure in the cylinder body 156 moves the head 152 along a direction, perpendicular to the extent of the support track 22, into or out of an aperture 160 in the support track 22.

Figure 10:
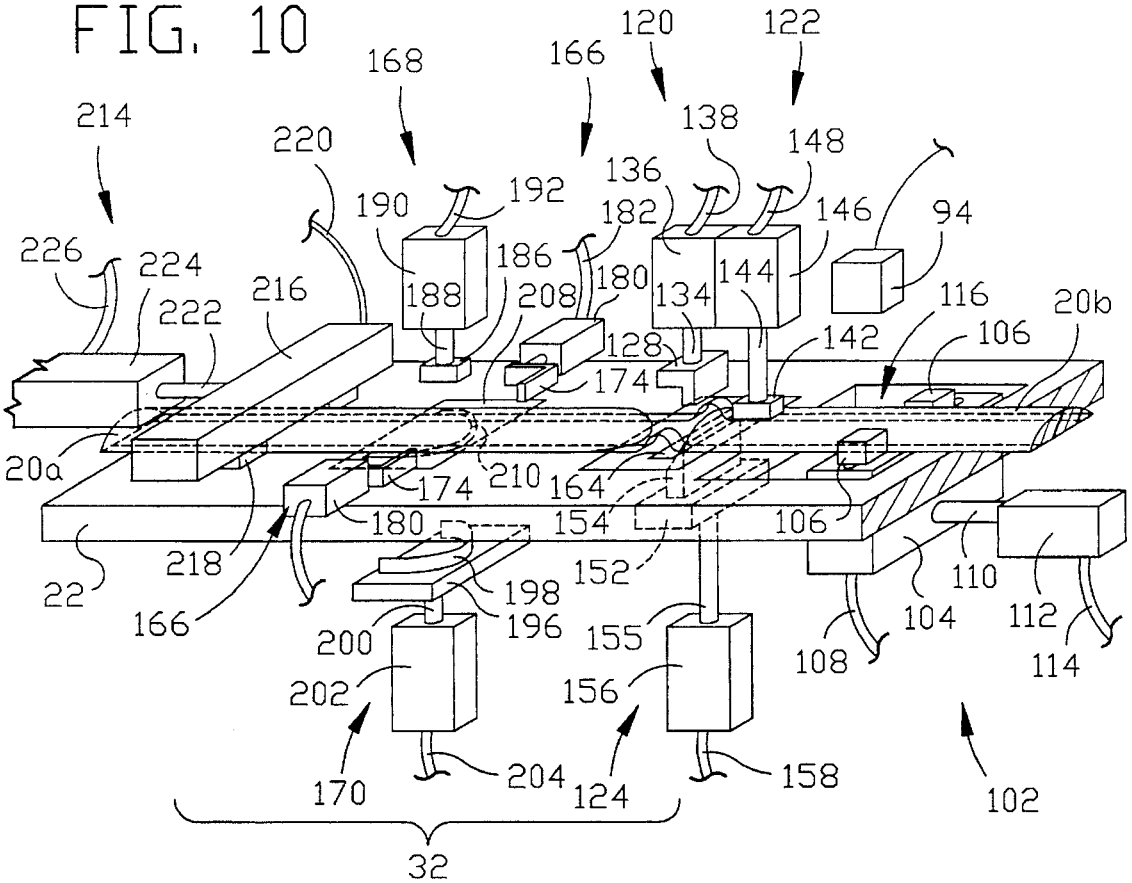
FIGS. 10–12 are views similar to FIG. 9 showing parts in other, sequential, operational positions.

A plate 162 is mounted in the aperture 160. The plate 162 has a slot 164 which is congruent to the shape of the knife edge 154 to allow the knife edge 154 to pass through the slot 164. The knife edge 154 is moved (FIG. 10) to extend through the slot 164 to engage and sever the continuous strip tape 14.

The first sever operation separates the segment of tape (shown in phantom) adhered to the leading workpiece 20*a* and the short following portion from the remainder of the continuous strip of tape 14 (shown in phantom) adhered to the following workpiece 20*b*. After the first sever operation, the leading workpiece 20*a* is free to be moved for further processing.

Figure 11:
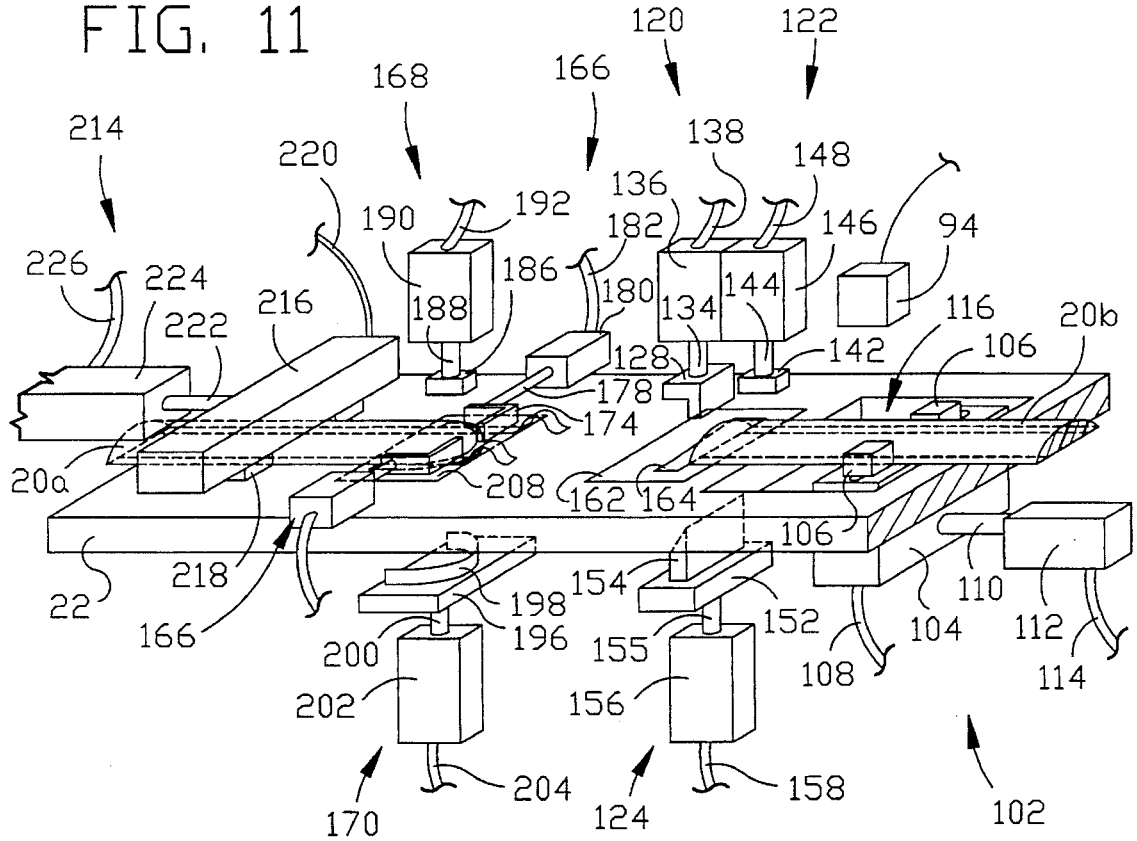

The cutting station 32 has a second sever group which includes two stop mechanisms 166 (FIG. 11), a hold down mechanism 168, and a sever mechanism 170. The stop mechanisms 166 are located on left and right sides, respectively, of the support track 22. Each of the stop mechanism 166 has similar structure and operates similarly. Thus, only one of the stop mechanisms 166 is described.

The stop mechanism 166 includes an L-shaped head 174. The head 174 is mounted on a piston 178 which is movable relative to a cylinder body 180. The cylinder body 180 is fixed relative to the support track 22. The piston 178 is movable relative to the cylinder body 180 under the influence of pneumatic pressure provided to the cylinder body 180 by a fluid line 182. The fluid pressure in the cylinder body 180 moves the piston 178 and the head 174 into or out of (FIG. 2) the stream of workpieces 20 along a direction which is perpendicular to the stream of workpieces 20.

When the head 174 is located in the path of the stream of workpieces 20 (FIG. 11), a trailing end of the leading workpiece 20*a* which is moved upstream relative to the support track 22 can abut against the leg of the L-shape. Abutment of the trailing end of the leading workpiece 20*a* against the head 174 locates the leading workpiece 20*a* in a position such that the second sever operation can be performed.

The hold-down mechanism 168 includes a head 186 (FIG. 11) for engaging each successive leading workpiece 20*a*. The head 186 is mounted on a piston 188. The piston 188 is movable relative to a cylinder body 190 under the influence of pneumatic pressure in the cylinder body 190 provided by a fluid line 192. The cylinder body 190 is fixed relative to the support track 122 such that the piston 188 and the head 186 are movable toward or away from the support track 22. Upon movement of the head 186 toward a down position (FIG. 12) the head 186 engages the leading workpiece 20*a* to hold the leading workpiece 20*a* at a location such that the second sever operation can take place.

The sever mechanism 170 (FIG. 11) is located beneath the support track 22. The sever mechanism 170 includes a head 196 upon which a knife edge 198 is mounted. The knife edge 198 has a shape to provide a desired cutting pattern. In the preferred embodiment, the knife edge 198 is shaped congruent to the trailing edge of the workpieces 20. The Figures show the knife edge 198 as having a generally U-shape. In the preferred embodiment, the knife edge 198 is sufficiently sharp to sever the tape. In addition, or alternatively, the knife edge 198 may be heated to a temperature sufficient to melt and sever the tape.

The head 196 is mounted on a piston 200 which is movable relative to a cylinder body 202 under the influence of pneumatic pressure provided by a fluid line 204. The cylinder body 202 is fixed relative to the support track 22 such that the piston 200 and the head 196 is movable relative to the support track 22 along a direction perpendicular to the flow of workpieces 20.

Figure 12:
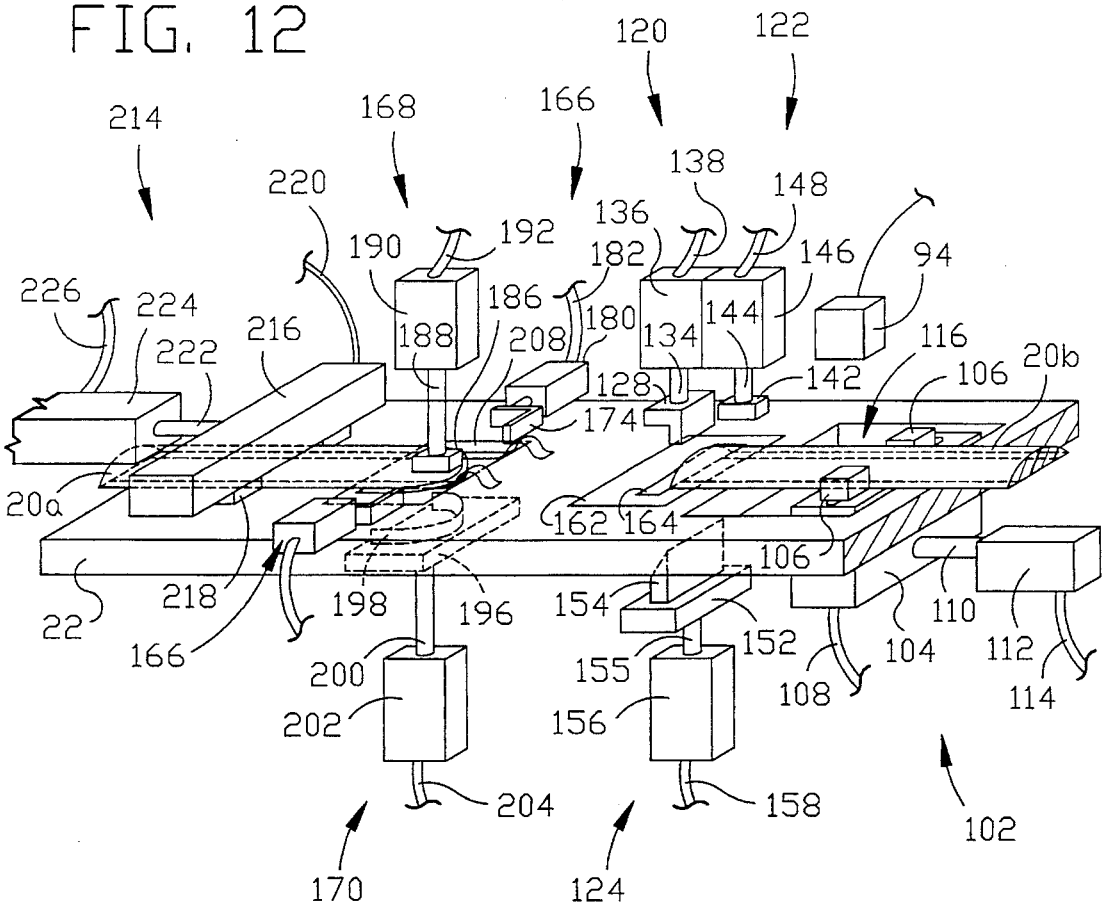

The head 196 (FIG. 1) is movable into an aperture 206 on the support track 22. A plate 208 is mounted in the aperture 206. The plate 208 has a slot 210 (FIG. 2) which is shaped in a manner congruent to the shape of the knife edge 198. The knife edge 198 is movable through the slot 210 to engage and sever the tape adjacent to the trailing end of the leading workpiece 20*a* (FIG. 12). The second sever operation separates the segment of tape adhered to the leading workpiece 20*a* from the short following portion of tape.

The position/removal station 34 (FIG. 1) includes a gripper/mover assembly 214. The gripper/mover assembly 214 is located above the support track 22 and includes a grip head 216 (FIG. 12). The grip head 216 has grip fingers 218 which extend toward the support track 22 and are located on respective left and right sides of the stream of workpieces 20. The grip fingers 218 are movable inwardly to grip each successive leading workpiece 20*a* under the influence of pneumatic pressure in the grip head 216 provided by a fluid line 220.

The grip head 216 is mounted on a piston 222 which is movable relative to a cylinder body 224. The cylinder body 224 is fixed relative to the support track 22. The piston 222 is movable relative to the cylinder body 224 under the influence of pneumatic pressure in the cylinder body 224 provided by a fluid line 226. The fluid pressure in the cylinder body 224 moves the piston 222 and the grip head 216 along a direction parallel to the extent of the support track 22. Upon gripping the leading workpiece 20*a* by the grip fingers 218, the piston 222 and the grip head 216 are moved upstream or downstream relative to the support track 22 to move the respective workpiece 20 upstream or downstream.

The gripper/mover assembly 214 can move the leading workpiece 20*a* downstream away from the first sever group or upstream toward the L-shaped heads 174 of the stop mechanisms 166 in the second sever group. In addition, the gripper/mover assembly 114 can move the leading workpiece 20*a* downstream, away from the cutting station 32 and toward the off-feed station 36. Moreover, the grip of the grip fingers 218 can be released to allow movement of the grip head 216 relative to the leading workpiece 20*a* for repositioning in a compound stroke movement.

Figure 13:
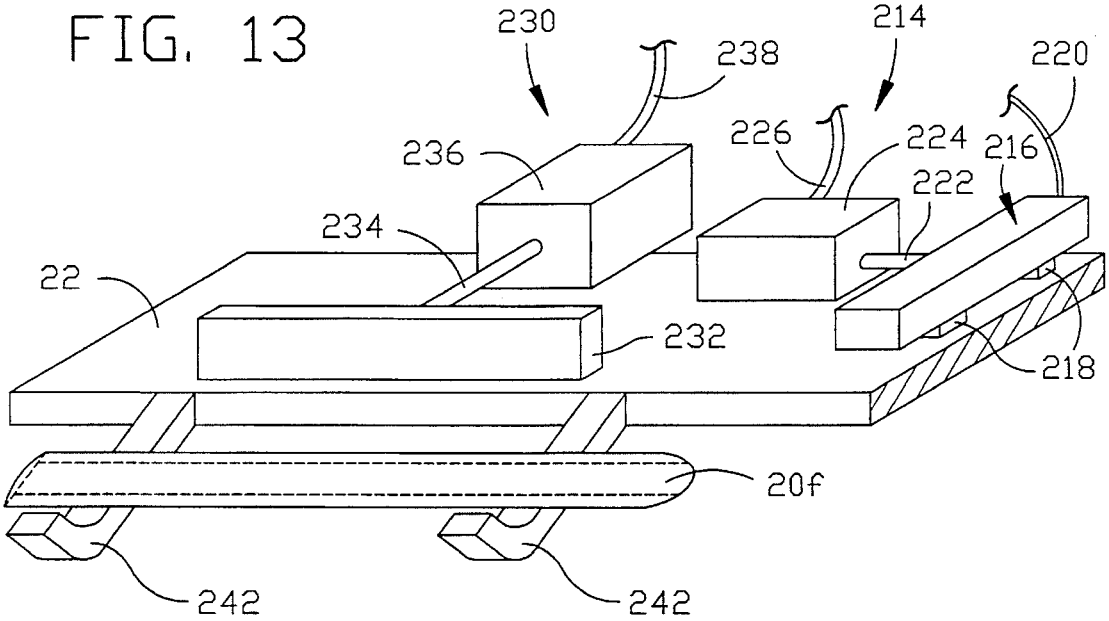
FIG. 13 is an enlarged, perspective view of a removal station and an off-feed station of the apparatus shown in FIG. 1.

The off-feed station 36 includes a push-off mechanism 230 (FIG. 13). The push-off mechanism 230 is mounted on top of the support track 22 at one side (FIG. 2). The push-off mechanism 230 includes a head 232 mounted on a piston 234. The piston 234 is movable relative to a cylinder body 236. The cylinder body 236 is fixed relative to the support track 22 and receives a pneumatic pressure via a fluid line 238. The pneumatic pressure within the cylinder body 236 moves the piston 234 and the head 232 across the support track 22 (FIG. 13) in a direction perpendicular to the flow of workpieces 20. The movement of the head 232 across the support track 232 pushes each subsequent leading workpiece 20*a* across and off of the support track 22. The workpiece 20, which is now designated as a finished workpiece 20*f*, is received in collection arms 242 which are mounted on the support track 22. Subsequent finished workpieces 20*f* are collected in the collection arms 242 for further processing or packaging by an operator.

The control of the various functions of the apparatus 10 (FIGS. 1 and 2), including the various pneumatic pressures for each of the pressurized fluid controlled devices, is provided by a control and fluid distribution mechanism 250 (schematically represented). The control and fluid distribution mechanism 250 includes a central processing and logic unit, a fluid valving network and a pressurized fluid source (not shown).

Operation of the apparatus 10 will now be described for the processing of a single workpiece 20 as the workpiece flows along the apparatus 10 and evolves from a trailing workpiece 20*b*, to a leading workpiece 20*a* and finally to a finished workpiece 20*f*. A leading workpiece 20*a* (FIG. 1) is located in the transfer station 30 and is presently stationary. The operator of the apparatus 10 places the trailing workpiece 20*b* into the workpiece feed station 26 such that the trailing workpiece 20*b* is aligned by the workpiece guides 56 and 60. The operator pushes the trailing workpiece 20*b* toward the application station 28. The leading edge of the trailing workpiece 20*b* engages the continuous strips of adhesive tape 14*a* and 14*b* at the pneumatic tape guide 66 (FIG. 6). The operator pushes the trailing workpiece 20*b* and the now engaged portion of tape, into the nip 80 of the press 72 and toward the stationary leading workpiece 20*a* (FIG. 7). As a result, the short following portion of tape which extends from the trailing edge of the leading workpiece 20*a* is buckled or folded. The short following portion of tape permits a short gap between the leading and trailing workpieces 20*a* and 20*b* across which the continuous strip of tape extends.

When the leading edge of the trailing workpiece 20*b* enters the nip 80, the rollers 76 and 78 grip and move the trailing workpiece 20*b* downstream while the continuous strips of tape 14*a* and 14*b* are pressed against the trailing workpiece 20*b*. The leading edge of the trailing workpiece 20*b* pushes against the trailing edge of the leading workpiece 20*a*. Thus, the trailing workpiece 20*b* pushes the leading workpiece 20*a* out of the transfer station 30 and into the cutting station 32. During this movement, sensor 92 and/or sensor 94 detect the movement of the leading workpiece 20*a* out of the transfer station 30. In response to the trailing workpiece 20*b* leaving the application station 28 and the leading workpiece 20*a* entering the cutting station 32, the control and fluid distribution mechanism 250 controls the stop mechanism 120 and the gripper/mover assembly 102. The gripper/mover assembly 102 grips the trailing workpiece 20*b* and moves the leading edge of the trailing workpiece 20*b* into engagement with the head 128. The control and fluid distribution mechanism 250 controls the hold-down mechanism 122 and the sever mechanism 124 to sever the continuous strip of tape 14 adjacent to the leading edge of the trailing workpiece 20*b*. The leading workpiece 20*a* is moved downstream and further processed until the leading workpiece 20*a* is moved off the support track 22 at the off-feed station 36 as a finished workpiece 20*f*.

Next, the operator feeds a subsequent workpiece 20 into the workpiece feed station 26. This will cause a change in designation of the previously identified trailing workpiece 20*b* to be termed the leading workpiece 20*a*. The now leading workpiece 20*a* is moved into the cutting station 32 via the now trailing workpiece 20*b* as previously described. Also, the continuous strips of tape 14*a* and 14*b* will be severed adjacent to the leading edge of the now trailing workpiece 20*b* as previously described. Once the first sever operation is complete, the control and fluid distribution mechanism 250 sequentially controls the apparatus 10 until the process is complete.

The grip head 216 of the gripper/mover assembly 214 is moved upstream relative to the leading workpiece 20*a*. The grip fingers 218 grip the leading workpiece 20*a* and the grip head 216 is moved downstream sufficiently far to move a trailing edge of the leading workpiece 20*a* downstream of the stop mechanisms 166. If necessary, the gripper/mover assembly may release the leading workpiece 20*a* and reposition the grip head 216 for a second stroke to ensure sufficient movement of the leading workpiece 20*a*. Once the trailing edge of the leading workpiece 20*a* is downstream of the stop mechanism 166, the L-shaped heads 174 are moved into the flow path of the leading workpiece 20*a*. The gripper/mover assembly 214 then moves the leading workpiece 20*a* upstream slightly such that the trailing edge of the leading workpiece 20*a* is moved into engagement with the L-shaped heads 174. The hold-down mechanism 168 and the sever mechanism 170 are actuated to sever the short following portion of tape from the section of tape which is adhered to the leading workpiece 20*a*.

The gripper/mover assembly 214 again strokes, and if necessary strokes a plurality of times, to move the leading workpiece 20*a* into the off-feed station 36. The gripper/mover assembly 214 moves the grip head 216 and the grip fingers 218 away from the leading workpiece 20*a*.

The push-off mechanism 230 strokes to sweep the head 232 across the support track 22 to push the leading workpiece 20*a* off of the support track 22 and into the collection arms 242. Thus, the leading workpiece 20*a* is finished and is designated a finished workpiece 20*f*. The trailing workpiece 20*b* which remains in the transfer station 30 is now designated the subsequent leading workpiece 20*a* and the process cycle is repeated.

Figure 15:
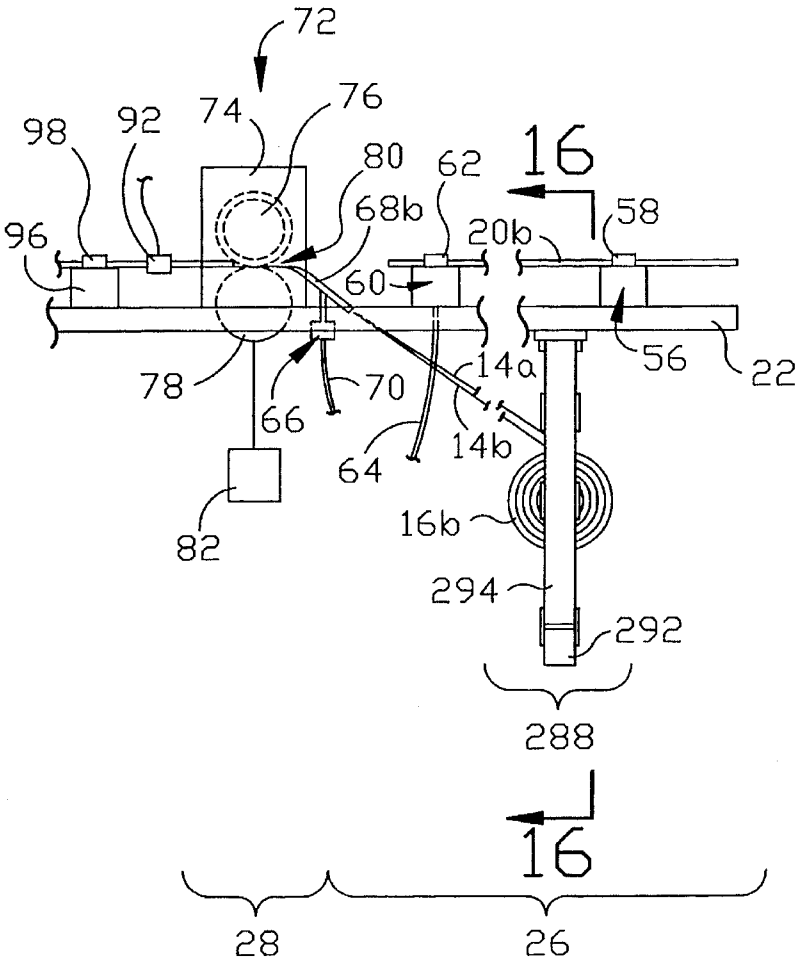
FIG. 15 is a schematic, partial view of a second embodiment of the present invention.

An alternative to the structure of the tape supply station 24 and the direction rollers 50*a*, 50*b* is a tape supply station 288 (FIG. 15) which is located below the first end portion of the track 22. The tape supply station 288 includes a fixed arm 290 which extends downwardly from the support track 22. A cross member 292 is fixedly connected to a lower end of the fixed arm 290 and extends perpendicular to the fixed arm 290. A pivotable arm 294 is pivotably connected at its lower end to the cross member 292. An upper end of the pivotable arm 294 is receivable in a locking bracket 296 beneath the support track 22. When the pivotable arm 294 is held in the locking bracket 296, the fixed arm 290 and the pivotable arm 294 face each other in vertical arrangement.

Figure 16:
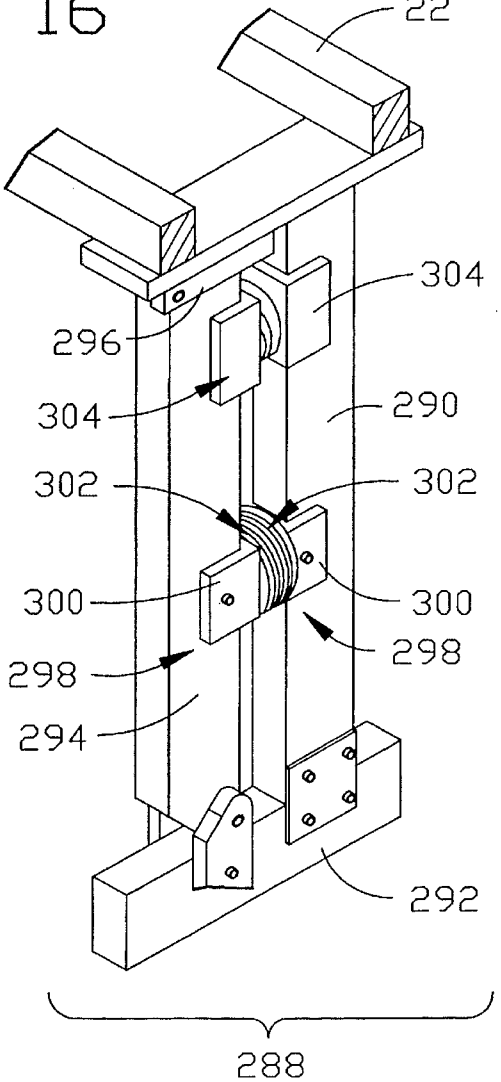
FIG. 16 is an enlarged view taken along line 16—16 of FIG. 15.

On each of the arms 290 and 294 is a hub assembly 298 (FIG. 16) attached at a mid-portion of the respective arm. The hub assembly 298 has a fixed bracket 300 and a rotatable hub 302. A respective one of the tape rolls 16 (not shown in FIG. 16, for clarity) is mountable on the hub 302 to permit rotation of the roll and extension of the strip of tape upwardly, toward the application station 28.

A slidable weight 304 is located on each respective arm above the hub assembly 298. Each weight 304 rests upon the respective roll 16 to provide a force for resisting removal of the tape from the roll 16. Each weight 304 is gravity biased downwardly so that as the diameter of the respective roll is reduced by usage, the weight 304 retains a constant pressure on the respective roll 16 to prevent inertial over run of the roll 16.

The hub assemblies 298 and their brackets 300 are located on inner sides of the arms 290 and 294 such that they face each other. This entraps the tape rolls 16 between the arms 290 and 294 to prevent the rolls 16 from falling. To replace the rolls 16, the pivotable arm 294 is released from the locking bracket 298 and pivoted away from the fixed arm 290, to expose the hub assemblies 298.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for applying segments of adhesive tape to workpieces, said apparatus comprising:

supply means for providing a continuous strip of tape;

force means for forcing the continuous strip of adhesive tape against successive workpieces as each workpiece and the continuous strip of tape are moved relative to said force means;

first stop means;

first mover means for moving first and second workpieces which are interconnected by a portion of the continuous strip of tape until an end of the second workpiece engages said first stop means;

first sever means for severing the continuous strip of tape adjacent to the end of the second workpiece;

second stop means;

second mover means for moving the first workpiece until an end of the first workpiece engages said second stop means; and second sever means for severing the tape associated with the first workpiece such that an affixed portion of the tape is separated from a tail portion which extends beyond the first workpiece.

2. An apparatus as set forth in claim 1 wherein said supply means includes:

support means for supporting a roll of the continuous strip of tape, said support means includes a planar member which is inclined at an angle relative to horizontal;

guide means for guiding movement of the roll of tape along said support means, said guide means includes an elongate groove in said planar member which extends in a direction of descent along said planar member;

retainer means for engaging the roll of tape and for retaining each successive layer of the continuous strip of tape on the roll of tape until the respective layer of tape is exposed and is pulled across said retainer means, said retainer means includes a projection extending from said planar member; and bias means for biasing the roll of tape against said retainer means, said bias means includes a weight engaged with the roll of tape to cause the roll of tape to slide in the direction of descent along said planar member toward said retainer means.

3. An apparatus as set forth in claim 1 wherein said supply means includes support means for supporting a roll of the continuous strip of tape for rotation, resistance means for providing a constant force which resists rotation of the roll of tape.

4. An apparatus as set forth in claim 1 wherein said force means includes a pair of rollers located to define a nip, each workpiece and the continuous strip of tape are moved between said rollers at said nip.

5. An apparatus as set forth in claim 4 wherein one of said rollers includes a deformable outer surface means for deforming as each workpiece engages said rollers.

6. An apparatus as set forth in claim 1 wherein said force means includes a roller having a deformable outer surface means for deforming as each workpiece engages said roller.

7. An apparatus as set forth in claim 6 wherein said deformable outer surface means is defined by a flexible outer cover surrounding a hollow interior of said roller which retains a fluid pressure, the fluid pressure provides a force for resisting deformation of said outer surface means as each workpiece engages said roller, said outer cover deforms congruently to the profile of each workpiece to distribute a pressure force across the profile of the workpiece.

8. An apparatus as set forth in claim 1 wherein said first mover means includes means for moving the second workpiece away from said force means and for moving a portion of the continuous strip of tape attached to the second workpiece such that the tape will interconnect the second workpiece and a subsequent workpiece.

9. An apparatus as set forth in claim 1 wherein said first mover means includes means for gripping the second workpiece and means for moving said means for gripping toward said first stop means.

10. An apparatus as set forth in claim 1 including means for moving said first stop means into a flow path of the second workpiece at a gap between the first and second workpieces across which the portion of tape extends.

11. An apparatus as set forth in claim 1 wherein said first sever means includes a knife edge which is moved in a direction perpendicular to a flow path of the second workpiece.

12. An apparatus as set forth in claim 1 wherein said first sever means includes a heated element for melting the tape.

13. An apparatus as set forth in claim 1 including means for holding the second workpiece in a position to permit said first sever means to sever the continuous strip of tape at a desired location.

14. An apparatus as set forth in claim 1 wherein said second mover means includes means for moving the first workpiece downstream away from the second workpiece and means for moving the first workpiece upstream toward said second stop means.

15. An apparatus as set forth in claim 14 wherein said second mover means includes means for gripping the first workpiece and means for moving said means for gripping the first workpiece.

16. An apparatus as set forth in claim 14 including means for moving said second stop means into a flow path of the first workpiece after said means for moving the first workpiece downstream has moved the first workpiece downstream and prior to said means for moving the first workpiece upstream moves the first workpiece upstream.

17. An apparatus as set forth in claim 1 wherein said second sever means includes a knife edge which is moved in a direction perpendicular to a flow path of the first workpiece.

18. An apparatus as set forth in claim 1 wherein said second sever means includes a heated element for melting the tape.

19. An apparatus as set forth in claim 1 including means for holding the first workpiece in a position to permit said second sever means to sever the tape at a desired location.

20. An apparatus as set forth in claim 1 including means for moving the first workpiece away from a position at which the first workpiece abutted said second stop means toward a collection location.

21. An apparatus for cutting a continuous strip of adhesive tape which is attached to first and second spaced apart workpieces, said apparatus comprising:

first stop means;

first mover means for moving the first and second workpieces which are interconnected by a portion of the continuous strip of tape until an end of the second workpiece engages said first stop means;

first sever means for severing the continuous strip of tape adjacent to the end of the second workpiece;

second stop means;

second mover means for moving the first workpiece until an end of the first workpiece adjacent to the portion of the tape engages said second stop means; and second sever means for severing the tape associated with the first workpiece such that an affixed portion of the tape is separated from a tail portion which extends beyond the first work piece.

22. An apparatus as set forth in claim 21 wherein said first mover means includes means for moving the second workpiece away from a location at which the continuous strip of tape is applied to each successive workpiece and for moving a portion of the continuous strip of tape which will interconnect the second workpiece and a subsequent workpiece past the location at which the tape is applied to each workpiece without contact with the subsequent workpiece.

23. An apparatus as set forth in claim 21 including means for moving said first stop means into a flow path of the second workpiece at a gap between the first and second workpieces across which the portion of tape extends.

24. An apparatus as set forth in claim 21 wherein said second mover means includes means for moving the first workpiece downstream away from the second workpiece and means for moving the first workpiece upstream toward said second stop means.

25. An apparatus as set forth in claim 24 including means for moving said second stop means into a flow path of the first workpiece after said means for moving the first workpiece downstream has moved the first workpiece downstream and prior to said means for moving the first workpiece upstream moves the first workpiece upstream.

26. An apparatus for applying a continuous strip of adhesive tape, having adhesive on each of two sides, to workpieces, said apparatus comprising:

supply means for providing the continuous strip of adhesive tape from a roll of the tape at a constant resistance, including;

support means for supporting the roll of tape;

guide means for guiding movement of the roll of tape along said support means;

resistance means for resisting movement of the tape;

retainer means for engaging the roll of tape and for retaining each successive layer of the continuous strip of tape on the roll until the respective layer of tape is pulled across said retainer means; and bias means for biasing the roll of tape against said retainer means; and force means for forcing the continuous strip of tape against successive workpieces as each workpiece and the continuous strip of tape are moved relative to said force means, including a roller having a deformable outer surface means for deforming as each workpiece engages said roller to congruently deform to the profile of each workpiece and distribute a pressure force across the profile of the workpiece;

said support means including a planar member inclined at an angle relative to horizontal, said guide means including an elongate groove in said planar member extending in a direction of descent along said planar member, said retainer means including a projection extending from said planar member, and said bias means including a weight engaged with the roll of tape to cause the roll of tape to slide in the direction of descent along said planar member toward said retainer means.

* * * * *